US010756479B2

(12) United States Patent
Lamb et al.

(10) Patent No.: US 10,756,479 B2
(45) Date of Patent: Aug. 25, 2020

(54) AUDIO CONNECTOR WITH INTEGRAL STRAIN RELIEF

(71) Applicant: Point Source Audio, Inc., Petaluma, CA (US)

(72) Inventors: James Lamb, Novato, CA (US); Yvonne Ho, Novato, CA (US)

(73) Assignee: Point Source Audio, Inc., Petaluma, CA (US)

( * ) Notice: Subject to any disclaimer, the term of this patent is extended or adjusted under 35 U.S.C. 154(b) by 44 days.

(21) Appl. No.: 16/020,997

(22) Filed: Jun. 27, 2018

(65) Prior Publication Data

US 2020/0006889 A1 Jan. 2, 2020

(51) Int. Cl.

| | |
|---|---|
| ***H01R 13/58*** | (2006.01) |
| ***H01R 13/40*** | (2006.01) |
| ***H04R 1/10*** | (2006.01) |
| ***H01R 13/506*** | (2006.01) |
| ***H01R 13/05*** | (2006.01) |
| *H01R 24/30* | (2011.01) |
| *H04R 1/40* | (2006.01) |
| *H01R 24/58* | (2011.01) |

(52) U.S. Cl.

CPC ..... *H01R 13/5845* (2013.01); *H01R 13/05* (2013.01); *H01R 13/506* (2013.01); *H04R 1/1033* (2013.01); *H01R 24/30* (2013.01); *H01R 24/58* (2013.01); *H04R 1/406* (2013.01)

(58) Field of Classification Search

CPC ..... H01R 13/58
USPC ..... 131/460, 606
See application file for complete search history.

(56) References Cited

U.S. PATENT DOCUMENTS

| | | | | |
|---|---|---|---|---|
| 4,257,666 | A * | 3/1981 | Schauer | H01R 13/502 439/460 |
| 4,861,276 | A * | 8/1989 | Muller | H01R 13/639 439/365 |
| 5,324,209 | A * | 6/1994 | Falossi | H01R 13/516 439/296 |
| 5,348,494 | A * | 9/1994 | Falossi | H01R 13/516 439/362 |
| 6,616,487 | B1 * | 9/2003 | Lai | H01R 24/58 439/606 |
| 7,052,281 | B1 * | 5/2006 | Meyberg | H02G 11/02 439/4 |
| 7,473,098 | B1 * | 1/2009 | Poulos | H01R 24/30 439/21 |
| 7,520,763 | B1 * | 4/2009 | Buse | H01R 25/142 439/121 |
| 2006/0073728 | A1 * | 4/2006 | Zaiken | A61B 5/6852 439/488 |
| 2006/0211293 | A1 * | 9/2006 | Li | H01R 13/5816 439/455 |

(Continued)

*Primary Examiner* — Abdullah A Riyami
*Assistant Examiner* — Thang H Nguyen

(57) ABSTRACT

An audio connector that has enhanced strain protection. Advantageously, the strain protection can be provided integral with the audio connector. In one embodiment, an audio connector includes an outer shell configured to connect to an audio system, an inner shell coupled to the outer shell, and a strain release member coupled to the inner shell. The strain release member can have a forward portion coupled to the inner shell and having a rearward portion extending rearward. The audio connector can also include a cable that can be secured to the rearward portion of the structural post.

19 Claims, 8 Drawing Sheets

(56) References Cited

U.S. PATENT DOCUMENTS

| | | | | |
|---|---|---|---|---|
| 2008/0082168 | A1* | 4/2008 | Peterman | A61F 2/4611 623/17.11 |
| 2011/0256756 | A1* | 10/2011 | Lu | H01R 13/6592 439/449 |
| 2012/0076342 | A1* | 3/2012 | Weber | D07B 1/16 381/384 |
| 2012/0149229 | A1* | 6/2012 | Kearsley | A61M 1/122 439/339 |
| 2013/0075149 | A1* | 3/2013 | Golko | H05K 9/0007 174/359 |

* cited by examiner

AUDIO CONNECTOR WITH INTEGRAL STRAIN RELIEF

BACKGROUND

Personal headsets for audio systems have been in use for many years, and for a variety of different applications. Users that typically desire quality audio headsets can include, for example, musical or theater artists, broadcasters, public speakers, telephone operators, dispatchers, airplane pilots, video camera operators, studio mixers, and professional sound technicians, among other various others. In many such occupations and applications, it may be desirable for such audio headsets to have speakers (e.g., earphones) and/or microphones. In the case of theater or musical productions, it is desirable that headset being worn by an artist not be noticeable to viewers, which can be members in an audience or viewers of a digital recording thereof.

Besides headsets, audio systems can also use wearable audio components, such as speakers or microphones. In one application, a microphone, as a separate component, is configured to be attached to a user (e.g., artist). The microphone is typically connected by wires and an audio connector to a wireless transmitter (sometimes referred to as a body-pack) that is also attached to the user. One type of microphone that is typically worn by a user is known as a lavalier microphone (or lavalier), which is a small microphone used for television, theatre, and public speaking applications in order to allow for hands-free operation.

Typically, a professional using an audio headset, wearable mounting, or individual component would have a microphone. A sound technician would check audio pickup from the microphone before the user starts her activity (e.g., show, shift, event, etc.). The microphone can be secured to a headset or ear mount/hook, or even to the user's body or clothing. The microphone might be integral with the headset, or attached to an ear mount/hook or to the user's body or clothing. A microphone can be attached to a user's body or clothing, such as with adhesive tape or cable binding sleeves (e.g., Hellerman sleeves). Regardless, audio setup is an important process and requires a period of time.

Hence, audio components, such as microphones or speakers, are often connected to audio systems by a cable containing wires and an audio connector. The wires from the audio component to the audio connector are at times subject to forces that induce stress on wired connections at the audio connector. These stresses can lead to loss of audio quality over time and can also lead to audio component failure. Conventionally, an aftermarket strain release might be formed by a wire bend and binding sleeve (e.g., Hellerman sleeve). Such an aftermarket solution is, however, bulky, cumbersome, visually unappealing, and requires additional effort and parts to be formed.

Hence, there is a need for improved designs in which audio connectors are able to endue strain induced thereon via its wires to an audio component, such as a microphone or speaker.

SUMMARY

The invention pertains to an audio connector with enhanced strain protection. Advantageously, the strain protection can be provided integral with the audio connector. In one embodiment, an audio connector includes an outer shell configured to connect to an audio system, an inner shell coupled to the outer shell, and a strain release member (e.g., structural post) coupled to the inner shell. The strain release member can have a forward portion coupled to the inner shell and having a rearward portion extending rearward. The audio connector can also include a cable that can be secured to the rearward portion of the structural post.

Embodiments of the invention can be implemented in numerous ways, including as a device, apparatus, system or method. Several embodiments of the invention are discussed below.

As an audio connector, one embodiment can, for example, include at least: an outer shell configured to connect to an audio system; an inner shell coupled to the outer shell; and a structural post coupled to the inner shell, the structural post having a forward portion coupled to the inner shell and having a rearward portion extending rearward.

As an audio connector, one embodiment can, for example, include at least: an outer shell configured to connect to an audio system; an inner shell coupled to the outer shell; and a strain release member coupled to the inner shell, the strain release member having a forward portion coupled to the inner shell and having a rearward portion extending rearward.

As an audio system, one embodiment can, for example, include at least: a cable including a plurality of wires; an audio connector coupled to one end of the cable; an audio component coupled to another end of the cable; and an audio device having a receptacle to which the audio connector can be attached. The audio connector integrally includes a strain release member. In one implementation, the audio device can be a wireless body pack, and the audio component can be a microphone.

As a method for assembling an audio connector, one embodiment can, for example, include at least: acquiring an electrical connector having an outer shell and an inner shell, the outer shell housing a plurality of electrical contacts; acquiring a strain release structure; acquiring a cable having a plurality of wires; coupling the strain release structure to the inner shell of the electrical connector; electrically connecting the wires in the cable to the electrical contacts housed in the outer shell; and securing the cable to the strain release structure.

Other aspects and advantages of embodiments of the invention will become apparent from the following detailed description taken in conjunction with the accompanying drawings which illustrate, by way of example, the principles of the invention.

BRIEF DESCRIPTION OF THE DRAWINGS

The accompanying drawings illustrate one or more exemplary embodiments and, together with the description of exemplary embodiments, serve to explain principles and implementations. The drawings are for illustration purposes and are not necessarily drawn to scale. The invention will be readily understood by the following detailed description in conjunction with the accompanying drawings, wherein like reference numerals designate like structural elements, and in which.

DETAILED DESCRIPTION OF EMBODIMENTS OF THE INVENTION

Audio connectors are commonly used for audio application. For example, an audio connector can be used to connect a microphone, such as a wearable microphone, to an audio system/device. More generally, the microphone can be referred to as an audio component. The audio system/device can be a wireless body pack that receives audio picked up from the microphone via one or more wires within a cable, and then wirelessly transmits the audio picked up to another audio system that stores and/or outputs the audio to a speaker system. The cable can at times be subjected to forces that stress the connections between the wires and conductors of the audio connector which can lead to poor audio quality or complete failure.

The invention pertains to an audio connector with enhanced strain protection. Advantageously, the strain protection can be provided integral with the audio connector. In one embodiment, an audio connector includes an outer shell configured to connect to an audio system, an inner shell coupled to the outer shell, and a strain release member (e.g., structural post) coupled to the inner shell. The strain release member can have a forward portion coupled to the inner shell and having a rearward portion extending rearward. The audio connector can also include a cable that can be secured to the rearward portion of the structural post.

The various aspects, features, embodiments or implementations of the invention described above can be used alone or in various combinations.

Embodiments of various aspects of the invention are discussed below with reference to FIGS. 1-9. However, those skilled in the art will readily appreciate that the detailed description given herein with respect to these figures is for explanatory purposes as the invention extends beyond these limited embodiments.

Figure 1:
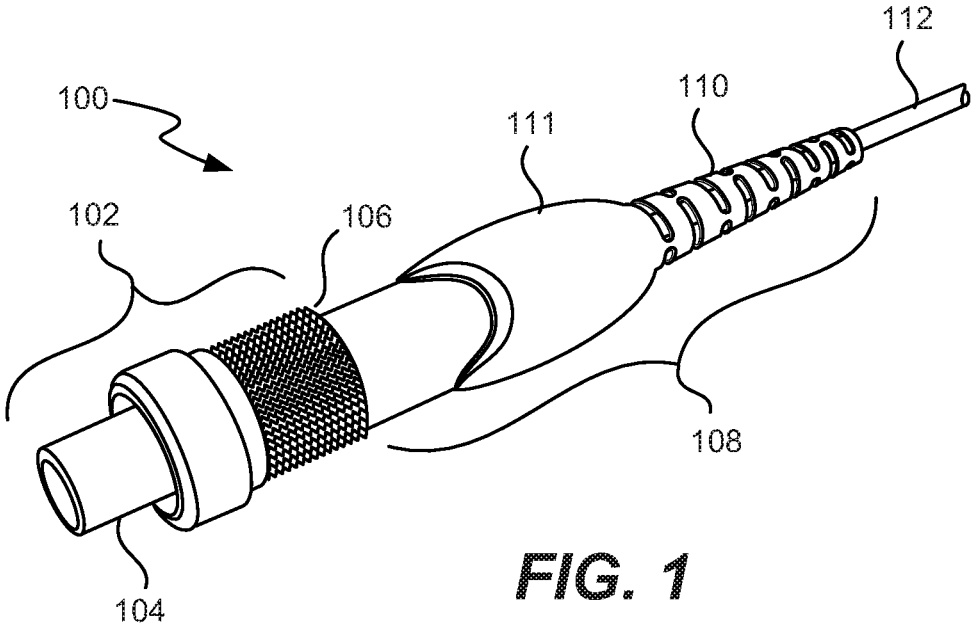
FIG. 1 is a perspective view of an audio connector according to one embodiment.

FIG. 1 is a perspective view of an audio connector 100 according to one embodiment. The audio connector 100 has an outer shell 102 that includes a forward end 104. The forward end 104 houses a plurality of electrical connection elements (not shown). The audio connector 100 also has an inner shell 106. A cover 108 can be coupled to the inner shell 106. The cover 108 can be secured to the inner shell 106 by adhesive, structural interference (e.g., friction), recess, detents, or any other known techniques. The cover 108 can include a rear portion 110 and a central portion 111. The rear portion 110 of the cover 108 can include a lateral strain release configuration (e.g., to protect the cable proximate to the rear portion 110 from damage from bending).

The audio connector 100 can also couple to a cable 112. Specifically, the cable 112 includes wires that are respectively electrically connected to the electrical connection elements housed within the forward end 104 of the outer shell 102. The audio connector 100 can also include a strain release member (not shown) internal to the cover 108. The strain release member can couple to the inner shell 106 and provide an elongated member to which the cable 112 can be secured.

Advantageously, forces applied to the cable 112 are absorbed by the elongated member of the strain release member so that the resulting strain being induced is substantially isolated from being imposed on the electrically connections between the wires within the cable 112 and the electrical connection elements housed in the forward end 104 of the outer shell 102.

The strain release member can be implemented in a variety of ways. In one embodiment, the strain release member is an elongated member that extends rearward to provide a securing platform to which the cable 112 can be secured. Such an elongated member can, for example, be a structural post. Optionally, the strain release member can include features, detents, holes, notches to assist in securing the cable 112 thereto. The shape of the strain release member, although generally elongated, can also vary with implementation, such as cylindrical, rectangular, or any other complex shape that facilitates securing the cable 112 thereto. For example, in one implementation, the strain release member can be configured as a rectangular elongated member.

The cable 112 can be secured to the strain release member in any of a variety of ways. In one embodiment, an attachment member is used to secure the cable 112 to the strain release member. In one implementation, the cable 112 can be secured to the strain release member using one or more knots formed with the cable 112 that secures the cable 112 to the strain release member. For example, the knot(s) can be or include a clove hitch. In another implementation, the cable 112 can be secured to the strain release member by another device, such as a nylon tie, wire, etc., that serves to secure the cable 112 to the strain release member. The knot(s), ties, wires, etc. can be referred to as attachment members.

The cover 108 can also include a central portion 111. The central portion 111 of the cover 108 can be slightly enlarged to be able to encompass the strain release member as well as the attachment member used to secure the cable 112 to the strain release member.

The cover 108 can be formed by any of a variety of materials, including plastic, metal, ceramic, silicone, wood, and the like, or some combination thereof. The cover 108 can be formed by a molding process, such as injection molding. In one implementation, the cover 108 can be formed of a plastic material that can be molded into the desired configuration. For example, the plastic material can be made of Polyvinyl Chloride (PVC).

The audio connector 100 can be coupled to one end of the cable 112. The audio connector 100 can couple to a counterpart audio connector of an audio apparatus (e.g., body pack, amplifier, etc.). The opposite end of the cable 112 can be coupled to an audio component. One type of audio component for use in the audio component 100 is a microphone for audio pickup. One suitable microphone is referred to as a lavalier microphone, which is a small electret or dynamic microphone, such as often use for theatre or and public speaking applications in order to allow for hands-free operation. Another type of audio component is an earphone. An earphone can, for example, also be or include an earbud. The audio apparatus can store, output or transmit audio picked-up to a speaker system.

Figure 2:
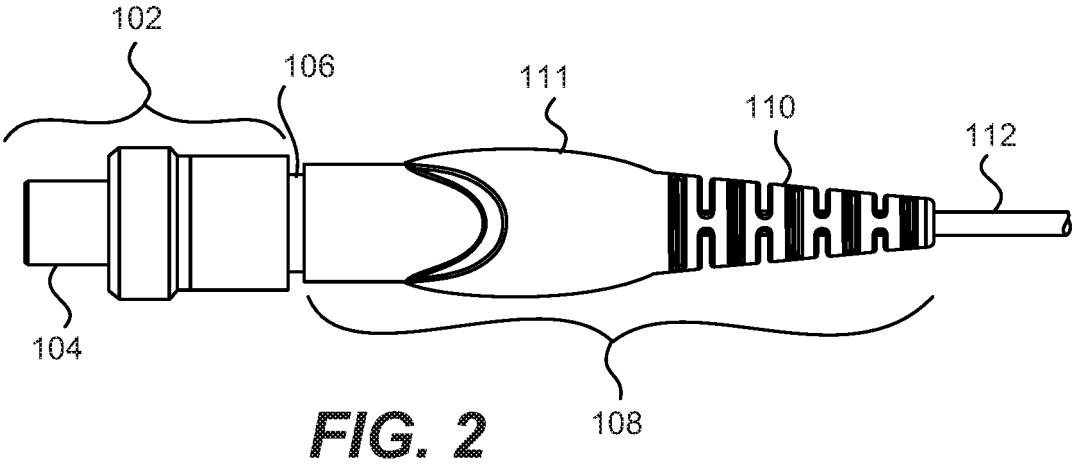
FIG. 2 is a top view of the audio connector shown in FIG. 1.
Figure 3:
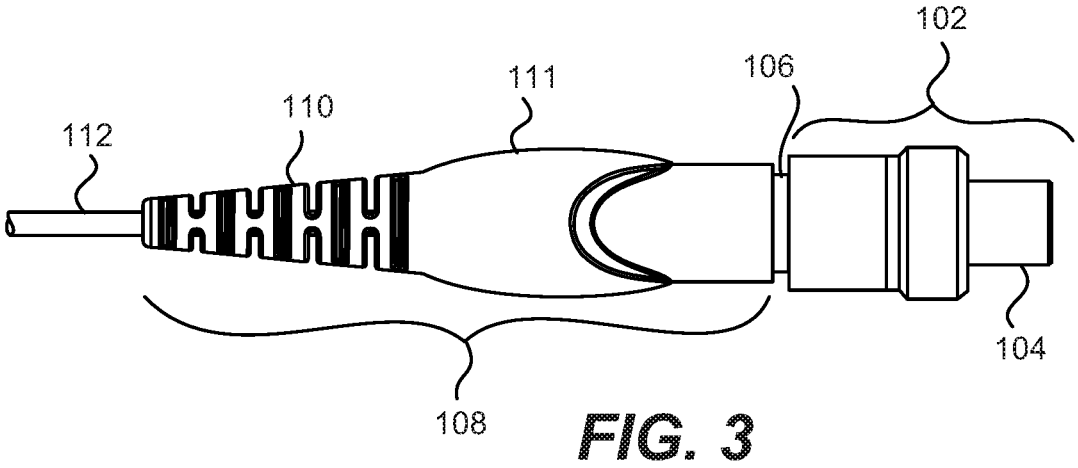
FIG. 3 is a bottom view of the audio connector shown in FIG. 1.
Figure 4:
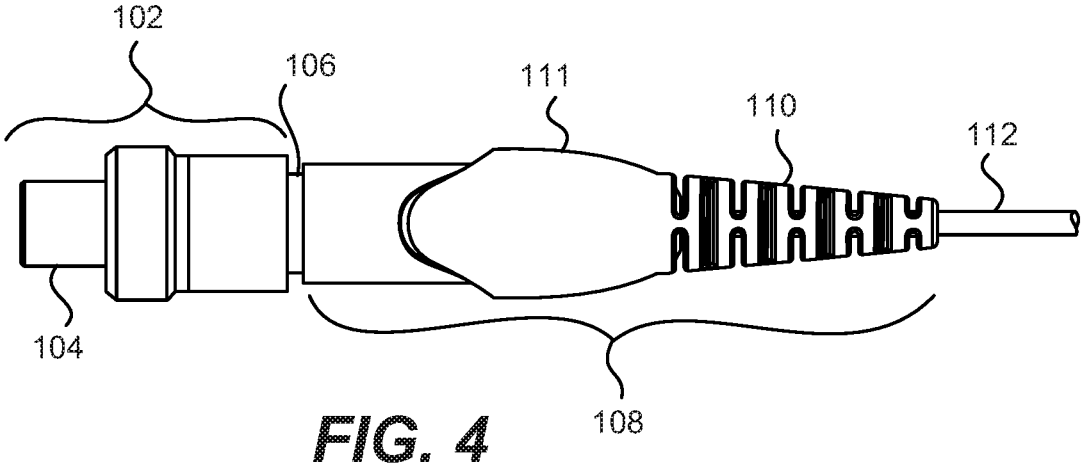
FIG. 4 is a left side view of the audio connector shown in FIG. 1.
Figure 5:
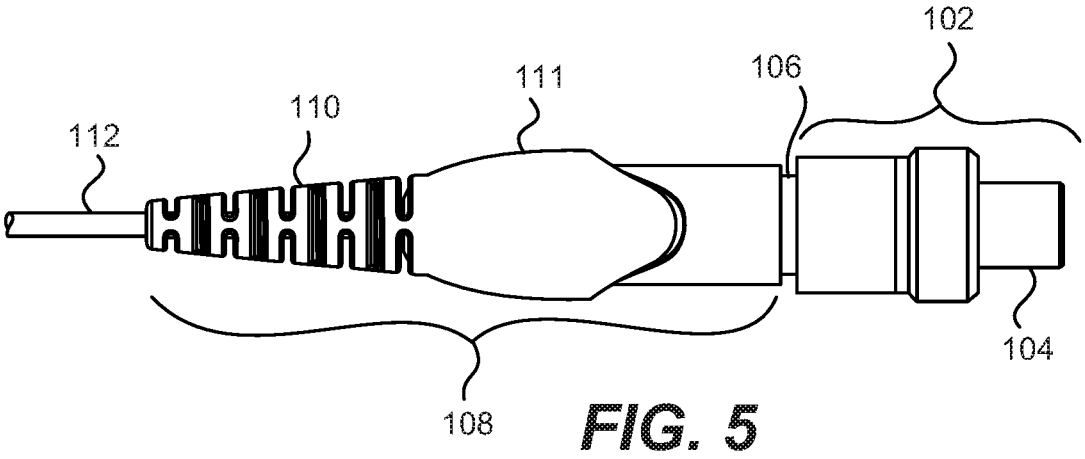
FIG. 5 is a right side view of the audio connector shown in FIG. 1.
Figure 6:
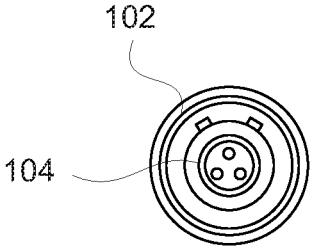
FIG. 6 is a front view of the audio connector shown in FIG. 1.
Figure 7:
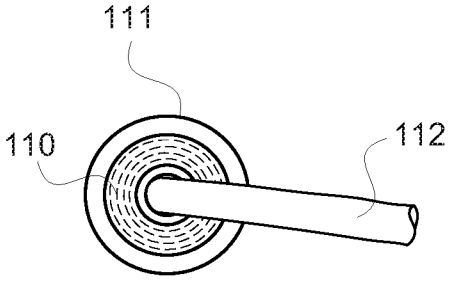
FIG. 7 is a back view of the audio connector shown in FIG. 1.

FIG. 2 is a top view of the audio connector 100 shown in FIG. 1, and FIG. 3 is a bottom view of the audio connector 100 shown in FIG. 1. In addition, FIG. 4 is a left side view of the audio connector 100 shown in FIG. 1, and FIG. 5 is a right side view of the audio connector 100 shown in FIG. 1. Furthermore, FIG. 6 is a front view of the audio connector 100 shown in FIG. 1, and FIG. 7 is a back view of the audio connector 100 shown in FIG. 1.

The particular configuration of the audio connector shown in FIGS. 1-7 is exemplary. Those skilled in the art will understand that the configuration and ornamental appearance of the audio apparatus can differ depending on implementation. As one example, the external shape or configuration of the audio connector can vary. In one particular embodiment, the audio connector can by sized to about 45-55 mm in length and about 5-10 mm in width.

Figure 8A:
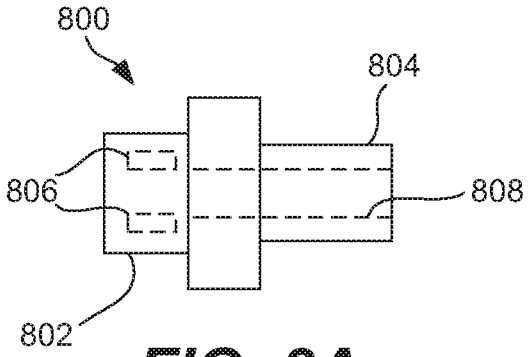
FIGS. 8A-8I are flow diagrams of an assembly of an audio connector according to one embodiment.

FIGS. 8A-8I are flow diagrams of an assembly of an audio connector according to one embodiment. The assembly is, for example, suitable for assembling an audio connector according to one embodiment FIG. 8A illustrates a shell 800 having an outer shell 802 and an inner shell 804 according to one embodiment. The outer shell 802 housing contacts 806. The inner shell 804 having an opening 808 extending there through. The outer shell 802 also has at least a partial opening there through. In one implementation, the inner shell 804 can be integral with the outer shell 802. In another implementation, the inner shell 804 is a separate piece from the outer shell 802, but the inner shell 804 can be assembled together with the outer shell 802.

Figure 8B:
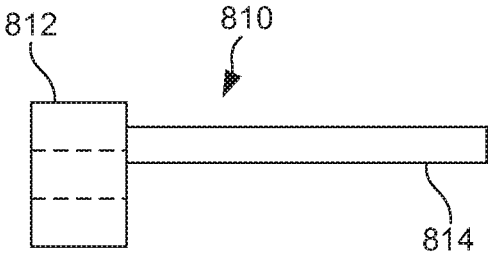

FIG. 8B illustrates a strain release member 810 according to one embodiment. The strain release member 810 can include a shell coupling side 812 and a cable coupling side 814. The shell coupling side 812 can couple to the inner shell 804 of the shell 800. The cable coupling side 814 can provide an elongated member (e.g., cylindrical or rectangular elongated member).

Figure 8C:
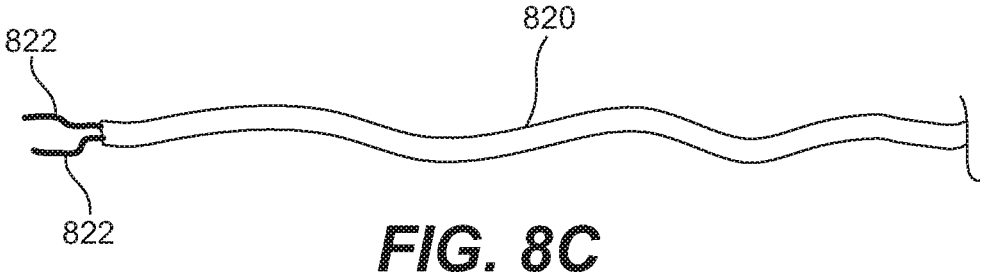

FIG. 8C illustrates a cable 820 that includes wires (conductors) 822 according to one embodiment.

Figure 8D:
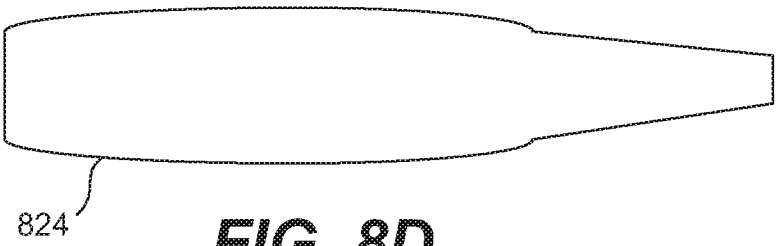

FIG. 8D illustrates a cover 824 that is provided to cover a significant portion of an assembled audio connector according to one embodiment.

Figure 8E:
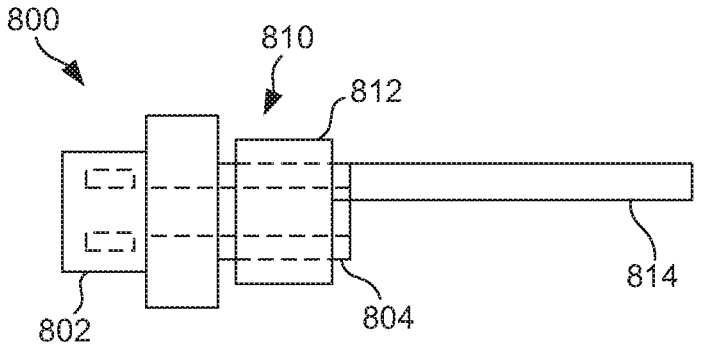

FIG. 8E illustrates the strain release member 810 being attached to the shell 800. Namely, in this embodiment, the shell coupling member 812 of the strain release member 810 is attached to the inner shell 804 of the shell 800. The attachment can be by any of a number of ways. For example, the attachment can use adhesive, screws, bolts, wires, threaded members, solder, welds, crimps, mechanical interference, etc.

Figure 8F:
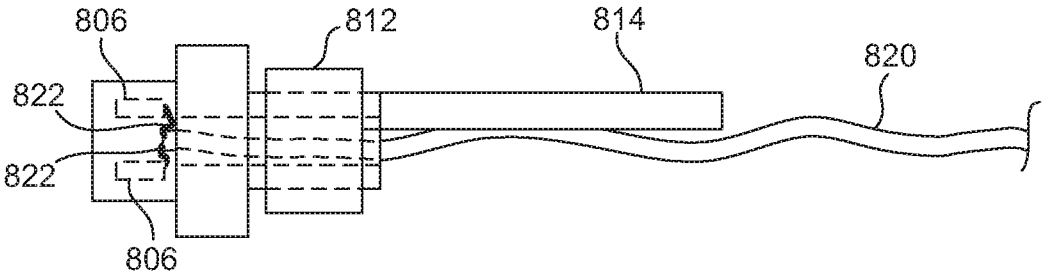

FIG. 8F illustrates the cable 820 coupled to the assembly shown in FIG. 8E. The cable 820 can extend through the inner shell 804 and at least a portion of the outer shell 802. The wires 822 of the cable 820 can be respectively connected to the contacts 806 of the outer shell 802. Typically, the wires 822 would be soldered to the respective contacts 806.

Figure 8G:
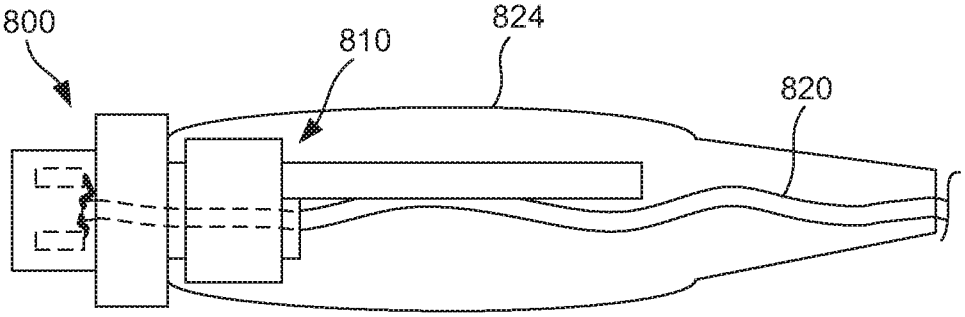

FIG. 8G illustrates the cover 824 affixed to the shell 800. For example, the cover 824 can be provided around the strain release member 810 and a portion of the cable 820. The cover 824 can also be provided around at least a portion of the shell 800, such as the inner portion 804. The cover 824 can be secured to the shell 800 by mechanical interference, adhesive, threaded members, detents, etc. The cover 824 can be formed of a molded material, such as plastic.

Figure 8H:
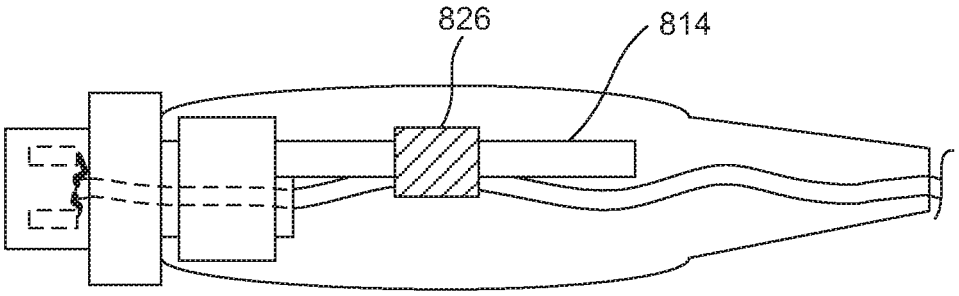

FIG. 8H illustrates one embodiment of an attachment member 826 being used to secure the cable 820 to the cable coupling side 814 of the strain release member 810. The attachment member 826 can be provided around the cable 820 and the cable coupling side 814. The attachment member 826 can, for example, be a nylon tie, metal wire or metal ring (e.g., crimped metal member). As forces (external to the audio connector) are induced on the cable 820 (e.g., longitudinal pulling of the cable 820), the attachment member 826 can insure that the resulting strain is transferred to the strain release member 810, and thus the force is not transferred to the wires 822 or the connections of the wires 822 with the contacts 806 within the outer shell 802.

Figure 8I:
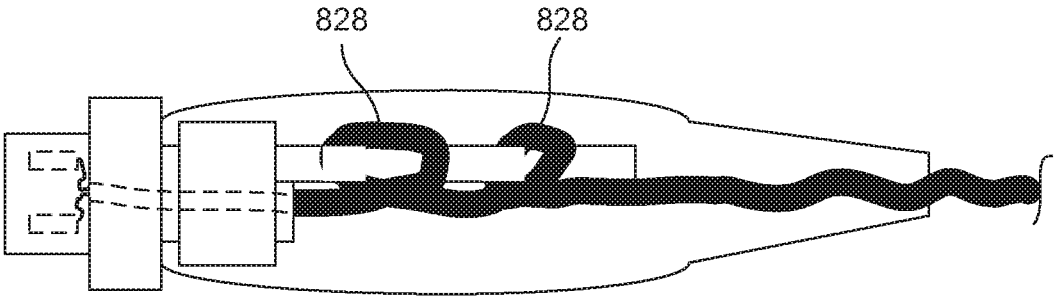

FIG. 8I illustrates one embodiment of one or more knots 828 being used to secure the cable 820 to the cable coupling side 814 of the strain release member 810. The one or more knots 828 are provided by the cable 820 itself and are formed around the cable coupling side 814 of the strain release member 810. In other words, the one or more knots 828 tie the cable 820 to the strain release structure. The particular knot used can vary with implementation. However, as depicted in FIG. 8I, the one or more knots 828 can be one or more clover hitches (e.g., two clover hitches are depicted in FIG. 8I). As forces (external to the audio connector) are induced on the cable 820, the one or more knots 828 can insure that the resulting strain is transferred to the strain release member 810, and thus the force is not transferred to the wires 822 or the connections of the wires 822 with the contacts 806 within the outer shell 802.

Figure 9:
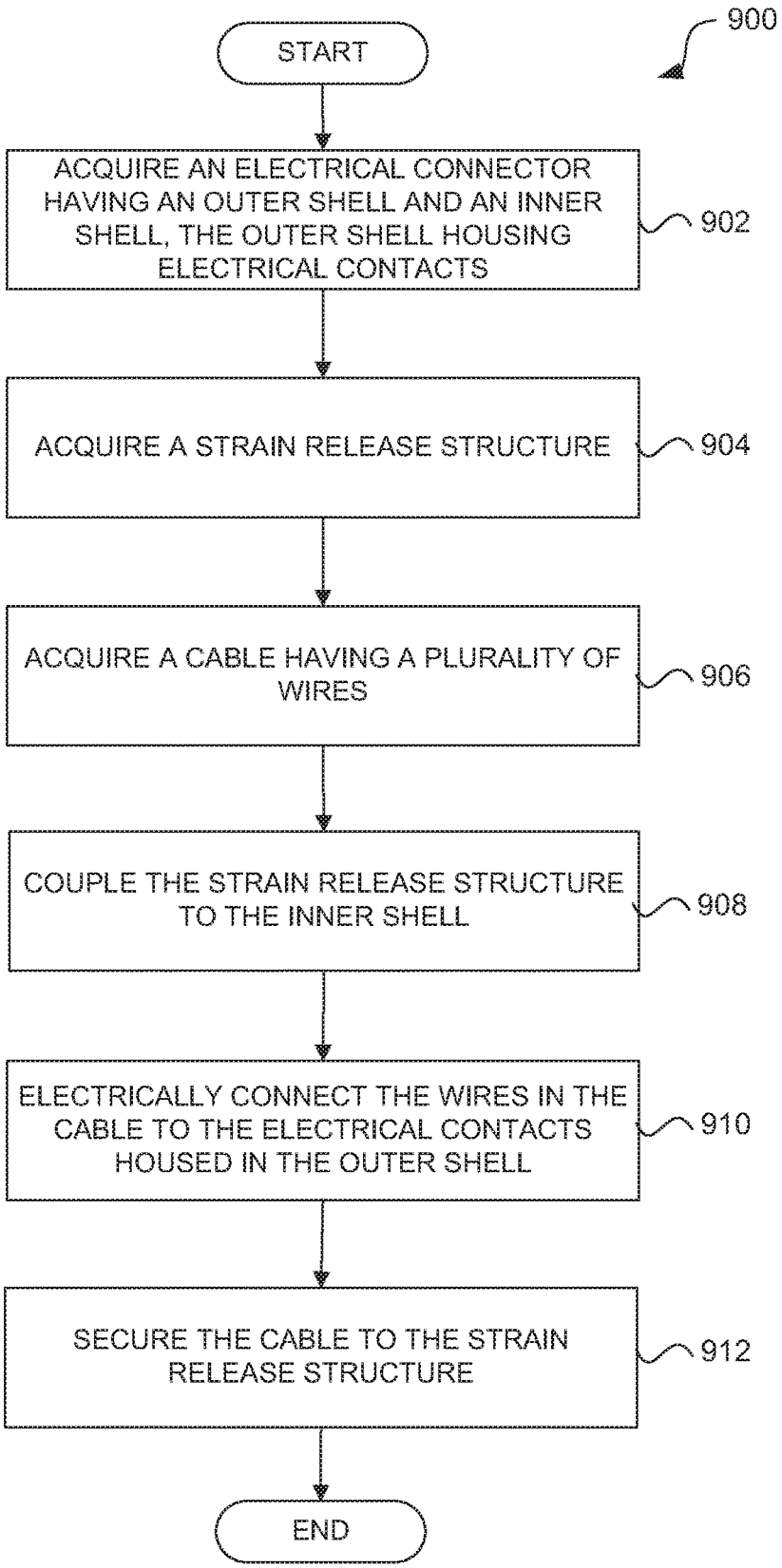
FIG. 9 is a flow diagram of an assembly process according to one embodiment.

FIG. 9 is a flow diagram of an assembly process 900 according to one embodiment. The assembly process 900 is, for example, suitable for assembling an audio connector according to one embodiment. The assembly process 900 can acquire 902 an electrical connector having an outer shell and an inner shell. The outer shell can house one or more electrical contacts. A strain release structure can also be acquired 904. Further, a cable having a plurality of wires can also be acquired 906. Next, the strain release structure can be coupled 908 to the inner shell. Thereafter, the wires within the cable can be electrically connected 910 to the electrical contacts housed in the outer shell. The cable can also be secured 912 to the strain release structure. After the cable has been secured 912 to the strain release structure, the assembly process 900 can end.

Furthermore, although not shown in FIG. 9, the assembly process can perform other operations. For example, the audio connector may have a cover that is configured to cover to the inner shell. The cover can also cover the strain release structure together with the cable secured thereto. The cover can be a molded plastic part that can be secured to the inner shell.

In alternative embodiments, the strain release structure can have different configurations. For example, the strain release structure can be an elongated rectangular member. As another example, the strain release structure can be an elongated cylindrical member, such as the spindle. In yet another embodiment, the string release structure can pertain to an elongated member having holes, slots or detents. Regardless of the particular implementation, the strain release structure serves as a structural component, typically rigid, to which the cable can be secured so that forces induced on the cable can be isolated from electrical connections with respect to wires within the cable and the audio connector. For example, the strain release member can be formed of metal, plastic, wood, etc.

In one embodiment, the cable coupled to the audio connector also connects to an audio apparatus. For example, the audio apparatus can be an audio component (e.g., a microphone) or a dedicated apparatus for microphones.

The audio apparatus can be attached to a user's clothing or body. The audio apparatus can be attached to or part of a headset or an ear mount. In one embodiment, an ear mount is configured to fit over an ear of a user. The ear mount can include one or more wire grooves to secure wires and/or the one or more audio components. The ear mount can be malleable so its shape can be customized for a given user. The ear mount can also be length alterable for customization of its size as well as placement of audio components. The ear mount can also facilitate rapid setup and/or alteration for individual users whereby different audio components and/or their placement can be customized. The ear mount can also be colored or camouflaged to match the user's skin or clothing. The ear mount can also be referred to as an ear mounting device. Additional details on ear mounts are contained in U.S. Pat. No. 9,706,285, which is incorporated herein by reference for all purposes.

An audio connector is also described and illustrated in U.S. Design Application No. 29/654834, filed Jun. 27, 2018, and entitled "AUDIO CONNECTOR," which is incorporated herein by reference for all purposes.

The various aspects, features, embodiments or implementations of the invention described above can be used alone or in various combinations.

Numerous specific details are set forth in order to provide a thorough understanding of the present invention. However, it will become obvious to those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

In the foregoing description, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

The many features and advantages of the invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. An audio connector, comprising:

an outer shell configured to connect to an audio system;

an inner shell coupled to the outer shell; and a structural post coupled to the inner shell, the structural post having a forward portion coupled to the inner shell and having a rearward portion extending rearward;

a cable secured to the structural post; and a cover, the cover provided over or around at least the structural post, wherein the cable is secured to the structural post using at least one knot, and wherein strain applied to the cable via a portion of the cable that is external to the audio connector is relieved by the structural post.

2. The audio connector as recited in claim 1, wherein the cable passes through a central portion of the inner shell, and wherein the cable is secured to the rearward portion of the structural post.

3. The audio connector as recited in claim 2, wherein the cable has a plurality of internal wires, and the internal wires at a first end of the cable are connected to conductors internal to the outer shell.

4. The audio connector as recited in claim 3, wherein strain applied to the cable via a portion of the cable that is external to the audio connector is relieved by the structural post such that less strain is applied to a portion the internal wires internal to the audio connector or to connections of internal conductors of the wires to the conductors internal to the outer shell.

5. The audio connector as recited in claim 1, wherein the cover is provided over the at least one knot.

6. The audio connector as recited in claim 1, wherein the knot is a clover hitch.

7. The audio connector as recited in claim 1, wherein the structural post is rigid.

8. The audio connector as recited in claim 1, wherein the structural post is metal or rigid plastic.

9. The audio connector as recited in claim 1, wherein the structural post is rigid.

10. The audio connector as recited in claim 1, wherein the cover is further provided over or around at least a portion of the cable secured to the structural post.

11. An audio connector, comprising:

an outer shell configured to connect to an audio system;

an inner shell coupled to the outer shell;

a strain release member attached to the inner shell, the strain release member having a forward portion attached to the inner shell and having a rearward portion extending rearward;

a cable secured to the strain release member; and a cover, the cover provided over or around at least the strain release member and a portion of the cable being secured to the strain release member;

wherein the cable is secured to the strain release member using at least one knot and wherein strain applied to the cable via a portion of the cable that is external to the audio connector is relieved by the strain release member.

12. The audio connector as recited in claim 11, wherein the cover is provided over the at least one knot.

13. The audio connector as recited in claim 11, wherein the cable is secured to the strain release member using an attachment member.

14. An audio system, comprising:

a cable including a plurality of wires; and an audio connector coupled to one end of the cable, wherein the audio connector includes at least:

an inner shell;

a structural post coupled to the inner shell, the structural post having a forward portion coupled to the inner shell and having a rearward portion extending rearward, the cable being secured to the structural post; and a cover, the cover provided over or around at least the structural post and a portion of the cable being secured to the structural post;

wherein the cable is secured to the structural post using at least one knot, and wherein strain applied to the cable via a portion of the cable that is external to the audio connector is relieved by the structural post.

15. The audio system as recited in claim 14, wherein the cover is provided over the at least one knot.

16. A method for assembling an audio connector, comprising:

acquiring an electrical connector having an outer shell and an inner shell, the outer shell of the electrical connector housing a plurality of electrical contacts;

acquiring a strain release structure;

acquiring a cable having a plurality of wires;

coupling the strain release structure to the inner shell of the electrical connector;

electrically connecting the wires in the cable to the electrical contacts housed in the outer shell;

securing the cable to the strain release structure; and applying a molded cover over at least a portion of the inner shell, the strain release structure and a portion of the cable;

wherein the securing of the cable to the strain release structure is achieved using a knot in the cable, the knot ties the cable to the strain release structure, and wherein strain applied to the cable via a portion of the cable that is external to the audio connector is relieved by the strain release structure.

17. The method as recited in claim 16, wherein the strain release member is integral with the audio connector.

18. The method as recited in claim 16, wherein the molded cover, after being applied, covers the knot that ties the cable to the strain release structure.

19. The audio connector as recited in claim 1, wherein the cover is a molded cover.

* * * * *